US006257683B1

(12) United States Patent
Yang

(10) Patent No.: US 6,257,683 B1
(45) Date of Patent: Jul. 10, 2001

(54) DETACHABLE RAIL FOR A DRAWER TRACK

(76) Inventor: Jun-Long Yang, No. 33, Da-Hsin 15 St., Tai-Ping City, Taichung Hsien (TW)

( * ) Notice: Subject to any disclaimer, the term of this patent is extended or adjusted under 35 U.S.C. 154(b) by 0 days.

(21) Appl. No.: 09/523,974

(22) Filed: Mar. 13, 2000

(51) Int. Cl.[7] ..... A47B 88/00
(52) U.S. Cl. ..... 312/333; 312/334.46
(58) Field of Search ..... 312/333, 334.44, 312/334.45, 334.46, 334.11, 334.7, 334.8, 334.17

(56) References Cited

U.S. PATENT DOCUMENTS 4,993,847 * 2/1991 Hobbs ..... 384/21
4,998,828 * 3/1991 Hobbs ..... 384/21
5,002,402 * 3/1991 Parvin ..... 384/21
5,169,238 * 12/1992 Schenk ..... 312/333
5,466,060 * 11/1995 Hoffman ..... 312/334.44
5,577,821 * 11/1996 Chu ..... 312/334.8
5,722,750 * 3/1998 Chu ..... 312/334.46

* cited by examiner

*Primary Examiner*—Peter M. Cuomo
*Assistant Examiner*—Jerry A. Anderson
(74) *Attorney, Agent, or Firm*—Dykema Gossett PLLC

(57) ABSTRACT

A detachable rail for a drawer track which essentially comprises a track and a rail is disclosed. By means of the limit block fixedly attached to the track and the limit device fixedly attached to the rail, it is very easy to detach the rail from and attach the rail to the track of a drawer.

5 Claims, 6 Drawing Sheets

DETACHABLE RAIL FOR A DRAWER TRACK

BACKGROUND OF THE INVENTION

1. Field of the Invention

The present invention relates to a detachable rail for a drawer track, more particularly, to a detachable drawer rail that comprises suitable means to facilitate removing and installing the rail on a drawer track.

2. Description of Related Art

With reference to FIGS. 7 and 8, a conventional retaining device for a drawer track in accordance with the prior comprises a track (60), a rail (70) slidably mounted in the track (60) and a retaining plate (90) attached to the rail (70). The conventional track further comprises a bearing (80) mounted between the track (60) and the rail (70) to make the rail (70) slide more easily in the track (60).

The track (60) is U-shaped and has two sidewalls (61) with a guide (63) defined in each sidewall (61). A guide (63) is formed on each sidewall (61). A limit notch (66) is formed on one end of the track (60), and a limit plate (64) extends perpendicular to the track (60) on the other end. The track (60) has multiple holes (65) defined in the bottom to allow the track (60) to be attached to a piece of furniture (not shown) by a screw (not shown) or a rivet (not shown).

The rail (70) is U-shaped and has two wings (72) with a sliding groove (74) defined in each wing (72). The sliding grooves (74) correspond to and align with the guides (63) in the track (60). The rail (70) has multiple holes (76) defined in the bottom to allow the rail (70) to be attached to a drawer (not shown).

The bearing (80) is U-shaped and has two sets of races (82) each received between the guide (63) in the track (60) and the sliding groove (74) in the rail (70). Multiple cavities (84) are defined in each of the races (82) to hold ball bearings (85) and allow the rail (70) to slide more easily in the track (60).

The retaining plate (90) is flexible. The first end (91) of the retaining plate (90) nearest to the limit plate (64) is attached to the track (60), and a lever (93) is formed on the second end (92). A square hole (94) is defined in the lever (93) to receive the limit notch (66) and lock the rail (70) with the track (70) in a fixed position. The lever (93) must be pressed to release the square hole (94) from the limit notch (66) so the drawer and the rail (70) can be pushed back or be drawn out completely and removed.

The conventional retaining device for a detachable drawer track keeps a drawer from inadvertently sliding completely out, yet allows the drawer to be removed when desired. However, it still has several disadvantages.

1. It presents a safety hazard. Whatever a user wants to push the drawer back or detach the drawer, he must press the lever (93) of the retaining plate (90). However, the retaining plate (90) always is a thin metal plate and formed by molding so the edge is very rough and sharp like a knife. Consequently, if a user is careless when pressing the retaining plate (90), his fingers are easily injured.

2. It is not very convenient. The conventional retaining device track (60) only has a limit notch (66) formed on one end. Consequently, the drawer often rebounds and extends again for some reason after being pushed in. It is not very convenient and sometimes a user may bump or hit the extended drawer.

The present invention has arisen to mitigate and/or obviate the disadvantages of the conventional retaining device for a detachable drawer track.

SUMMARY OF THE INVENTION

In accordance with one aspect of the present invention, a detachable rail for a drawer track is provided. The detachable rail for a drawer track in accordance with the present invention essentially comprises a track and a rail. Because of the limit block fixedly mounted on the track and the limit device fixedly mounted on the rail, it is very easy to detach the rail from and attach the rail to the track of a drawer.

Further benefits and advantages of the present invention will become apparent after a careful reading of the detailed description with appropriate reference to the accompanying drawings.

DETAILED DESCRIPTION OF EMBODIMENTS

Figure 1:
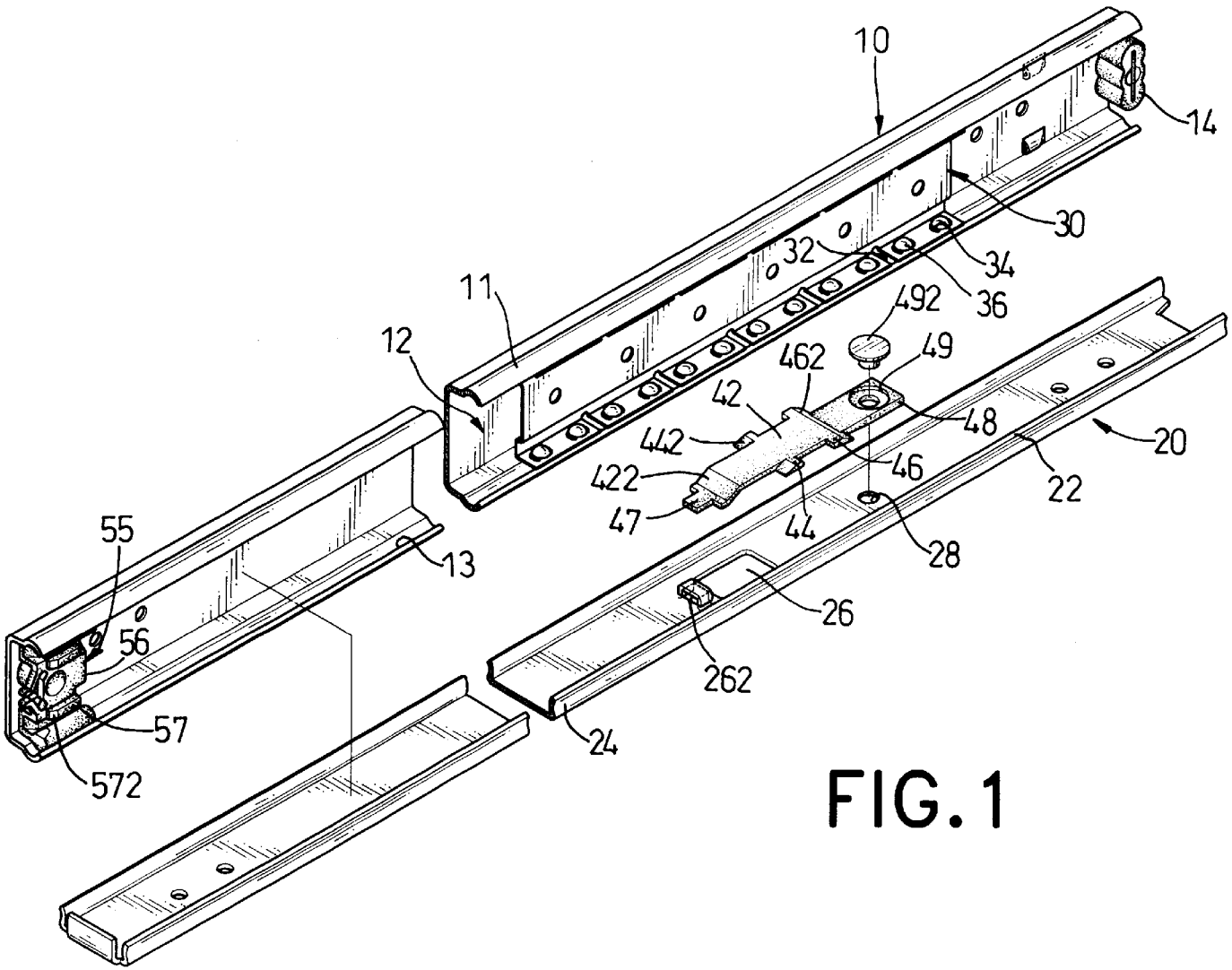
FIG. 1 is a partially exploded perspective view of a detachable rail for a drawer track in accordance with the present invention.
Figure 2:
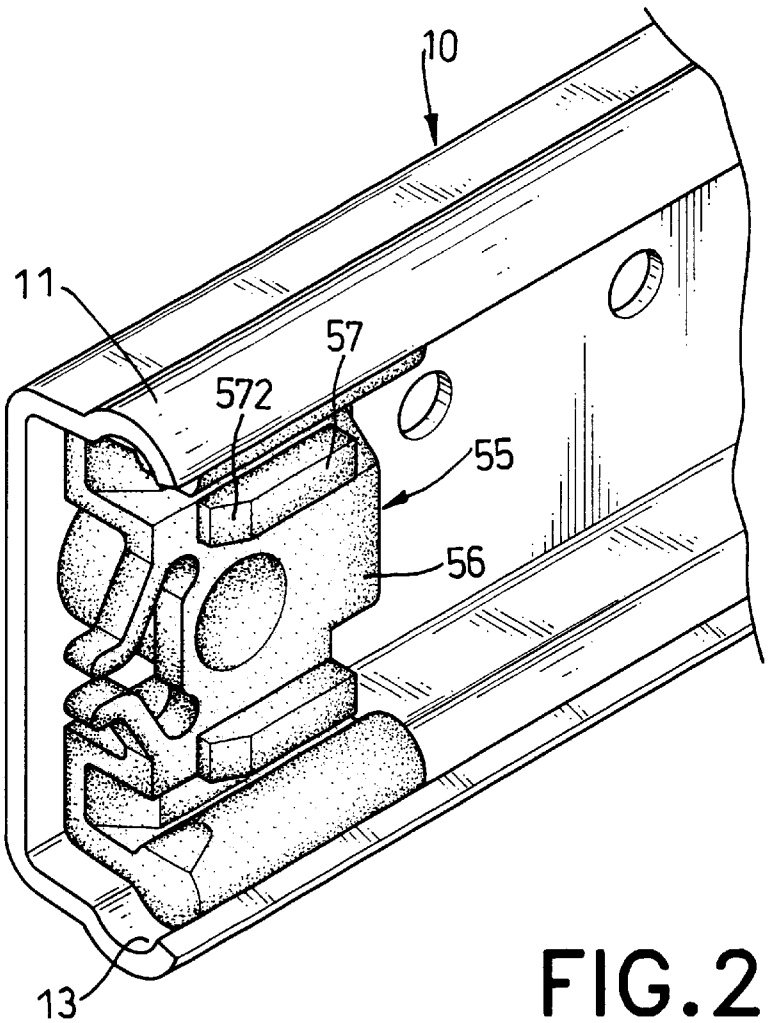
FIG. 2 is an enlarged perspective view of the end of the detachable rail for a drawer track in FIG. 1.

With reference to FIG. 1 and FIG. 2, the detachable rail for a drawer track in accordance with the present invention essentially comprises: a track (10), a bearing (30), a rail (20) and a limit device (40). The bearing (30) is slidably mounted in the track (10). The rail (20) is slidably mounted in the bearing (30) such that the rail (20) can slide in the track (10) and is limited to one longitudinal end of the track (10). The limit device (40) is fixedly attached to the rail (20) and is located between the rail (20) and the track (10).

The track (10) contains a slide wall (11) integrally extending from each side so that a sliding area (12) is formed between the slide walls (11). Each slide wall (11) has a guide (13) extending from the edge of the slide wall (11). A limit plate (14) is located at one end of the sliding area (12), and a limit block (55) is located at the other end of the sliding area (12).

The bearing (30) is essentially U-shaped and has a set of races (32) on the legs of the "U". Each set of races (32) comprises multiple cavities (34), and each one of the cavities (34) contains a ball bearing (36). The size of the ball bearing (36) is so configured that the bearing (30) is slidable in the guide (13) of the track (10).

The rail (20) is also essentially U-shaped and comprises a wing (22) on each side. The outer side of each wing is curved to form a sliding groove (24). The size of each sliding groove (24) corresponds to the size of the ball bearings (36) has an opening (26) is also defined in the rail (20), and a lip (262) is defined in the rail (20) at one end of opening (26). A hole (28) is defined in the rail (20) at the other end of the opening (28).

The limit device (40) comprises a elevated body (42). Two limit protrusions (44, 46) are defined on each side of the elevated body (42). An inclined edge (462) is formed on the fixed end of the elevated body (42) and includes the edge of the limit protrusions (46). An inclined face (422) is formed at the other end of the elevated body (42). From the end each of the slant edge (462) and the slant face (422), an attachment plate (48) integrally extends from the inclined edge (462) or the elevated body (42). The attachment plate (48) contains a through hole (49). The through hole (49) corresponds to the hole (28) in the rail (20), so that an attachment device such as a pin (492) can fixedly attach the extending plate (48) of the limit device (40) to the rail (20). A tab (47) extends from the base of the inclined face (422) of the elevated body (42) and is fixedly inserted under the lip (262) in the rail (20).

With reference to FIG. 2, the limit block (55) comprises a block body (56) that is fixedly mounted on the track (10). The block body (56) comprises two locking protrusions (57) integrally extending form one side of the block body (56). Each of the locking protrusions (57) contains an inclined edge (572) on one end.

Figure 3:
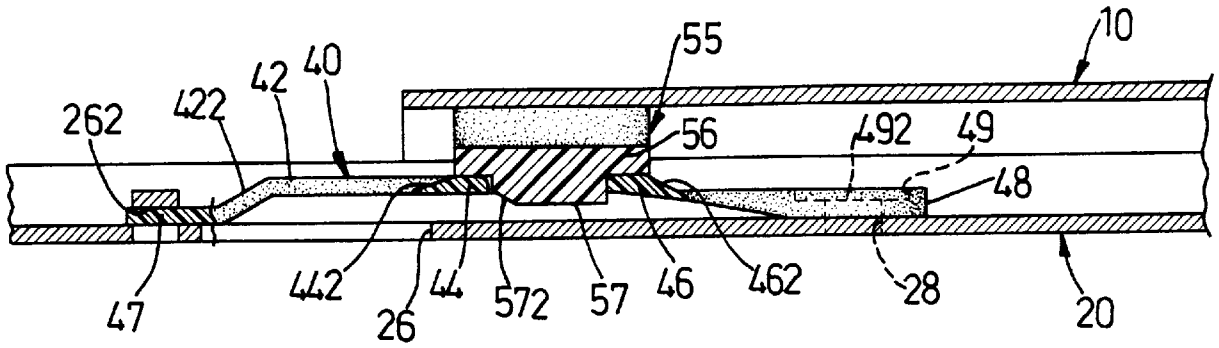
FIG. 3 is a side plan view in partial section of the detachable rail for a drawer track of FIG. 1.

With reference to FIG. 1 and FIG. 3, the limit device (40) is locked between the track (10) and limit block (55) when the locking protrusions (57) are locked between the limit protrusions (44, 46) of the limit device (40). In such a state, owing to the slant edge (442), it is very easy to push the rail (20) into the track (10) (see FIG. 6); and, when the end of the rail (20) touches the limit plate (14), the limit plate (14) can slightly lock the end of the rail (20).

Figure 6:
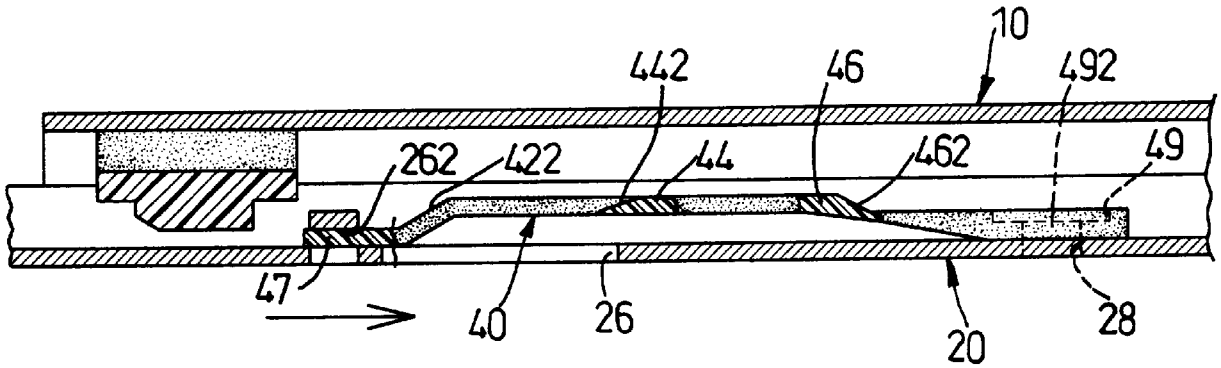
FIG. 6 is a side plan view in partial section of the detachable rail for a drawer track of FIG. 1 detached from the track.
Figure 7:
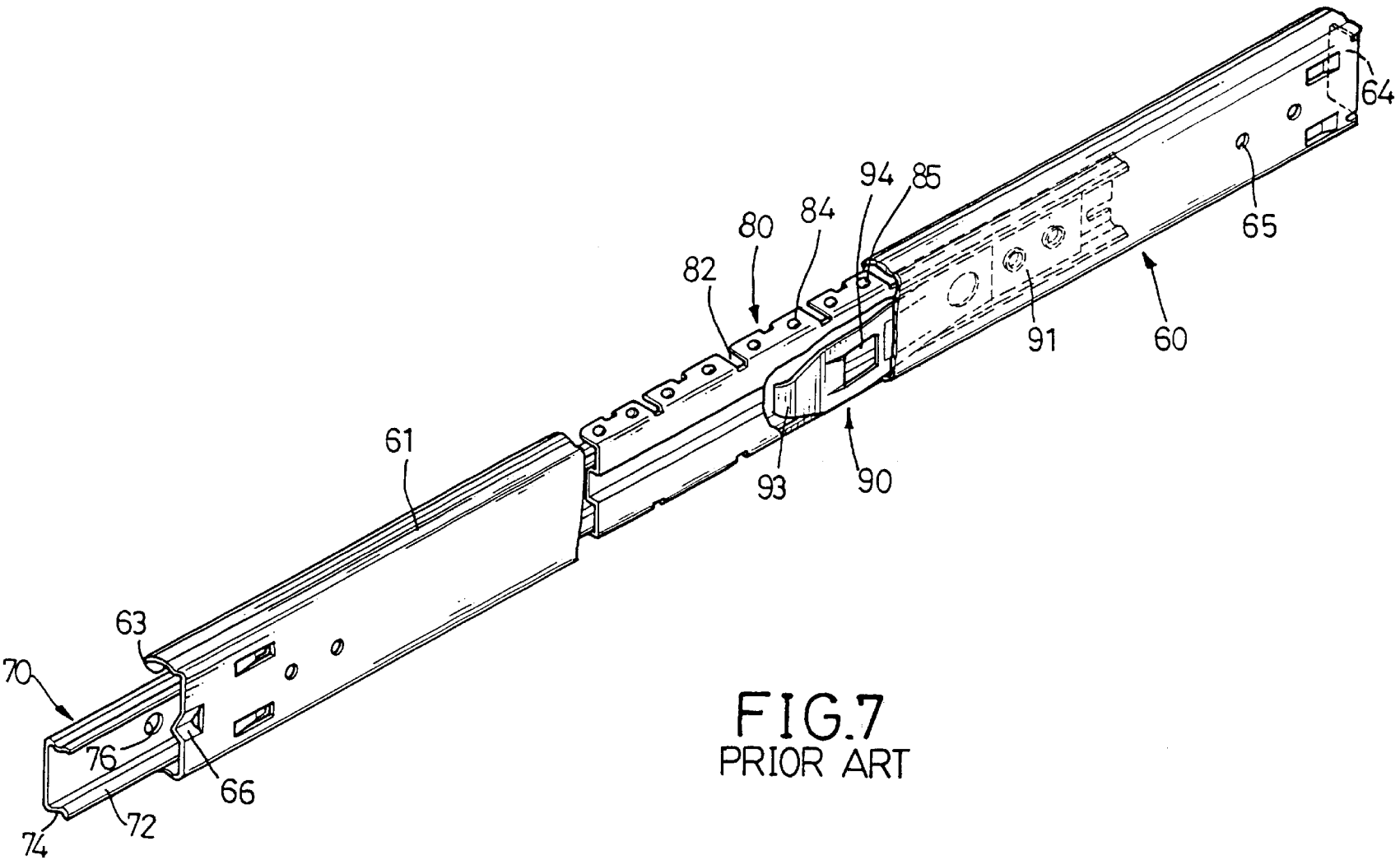
FIG.7 PRIOR ART
FIG. 7 is a perspective view in partial section of a conventional retaining device for a detachable drawer track in accordance with the prior art.
Figure 8:
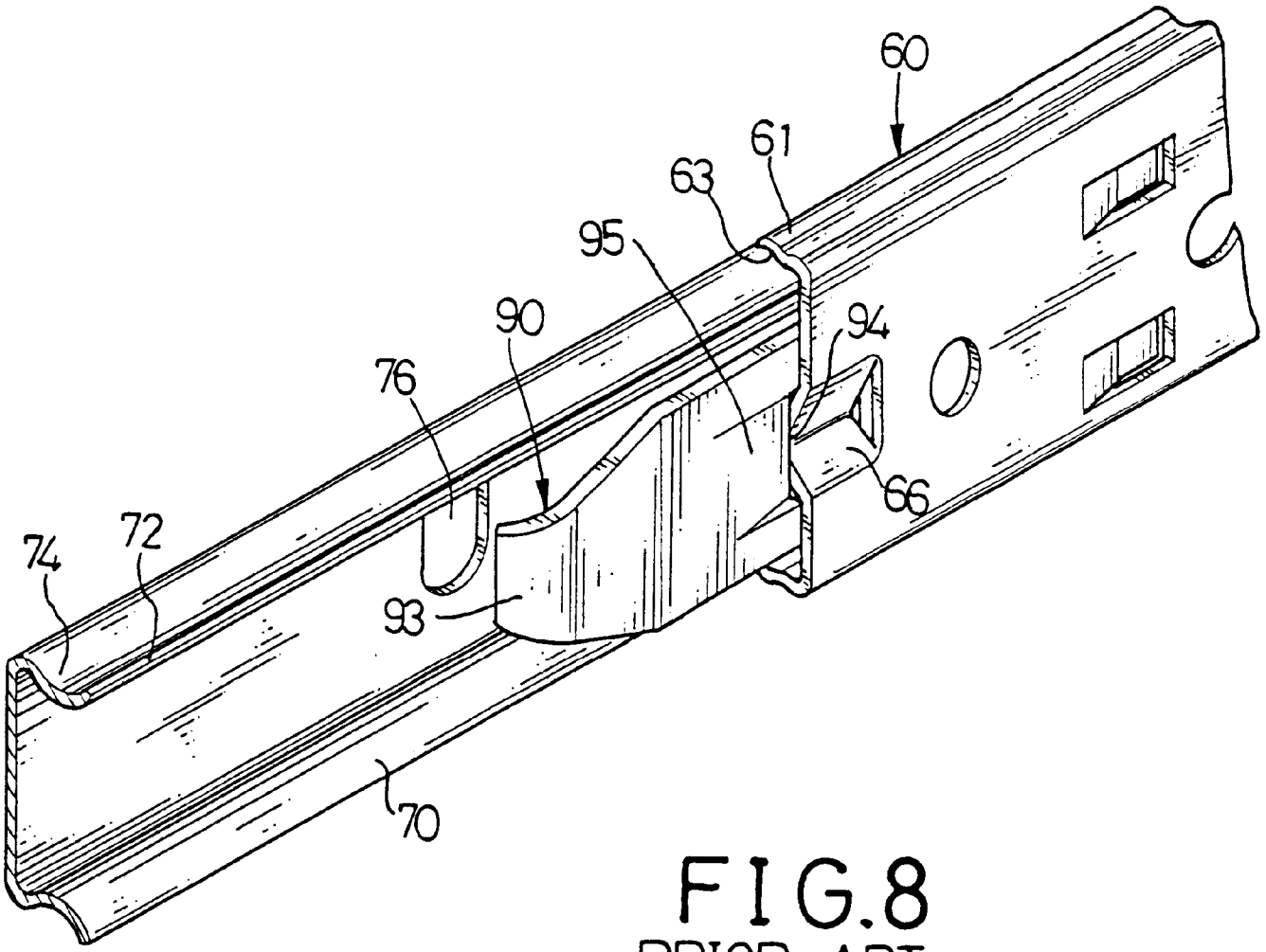
FIG.8 PRIOR ART
FIG. 8 is a partial perspective view in partial section of the conventional retaining device in FIG. 6 when retaining.

With reference to FIGS. 1 and 6, when the limit device (40) is disengaged from the locking protrusions (57) on the limit block (55), the rail (20) can be pushed all the way in, and the inclined edge (462) on the elevated body (42) of the limit device (40) will wedge with the limit plate (14) to hold the drawer completely in.

Figure 4:
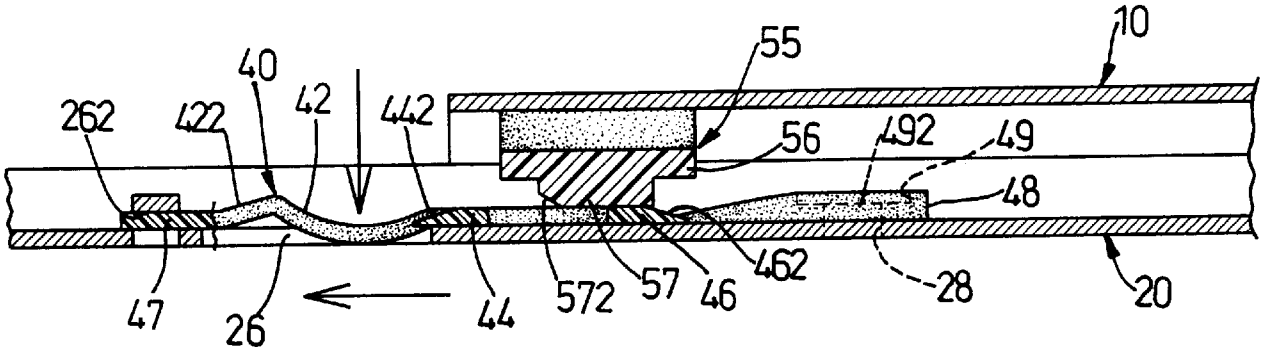
FIG. 4 is a side plan view in partial section of the detachable rail for a drawer track of FIG. 1 locked to the track.

With reference to FIG. 1 and FIG. 4, if one wants to pull the rail (20) out of the track (10), the elevated body (42) of the limit device (40) must be pushed down so that the elevated body (42) will bend down into the opening (26), such that the limit protrusions (44, 46) are released from the locking protrusions (57) (58). Then the rail (20) together with the limit device (40) can be drawn out of the track (10) as shown in FIG. 5.

Figure 5:
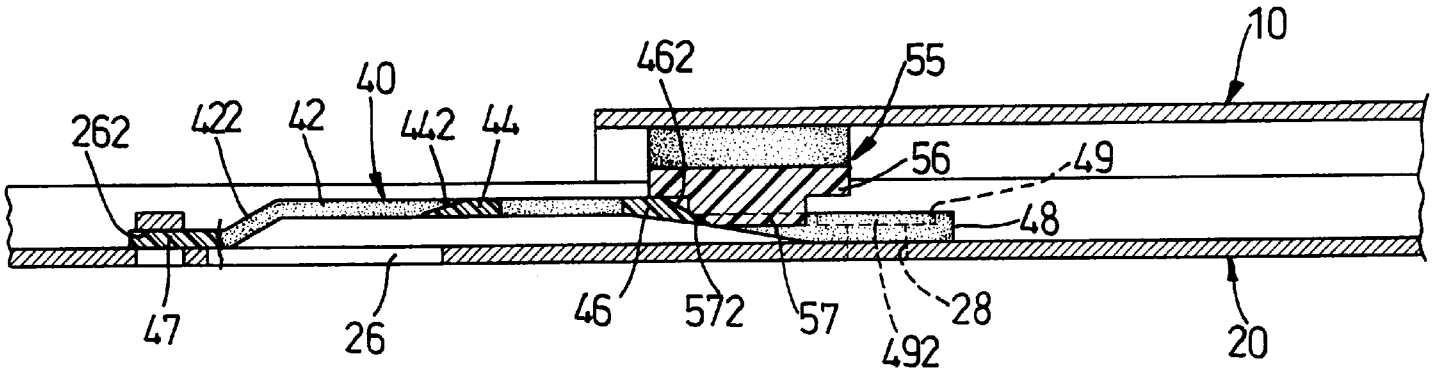
FIG. 5 is a side plan view in partial section of the detachable rail for a drawer track of FIG. 1 being detached from the track.

With reference to FIG. 1 and FIG. 5, if one wants to push the rail (20) into the track (10) again, he may directly insert one end of the rail (20) into the track (10). Due to the inclined edge (462) of the limit device (40) and the inclined edges (572) of the locking protrusions (57) on the limit block (55), the rail (20) can be smoothly slid into the track (10) as shown in FIG. 6.

What is claimed is:

1. A detachable rail for a drawer track essentially comprising:

a track (10);

a bearing (30) slidably mounted in the track (10);

a rail (20) slidably mounted in the bearing (30) such that the rail (20) can slide in the track (10) and can be held at one longitudinal end of the track (10); and a limited device (40) fixedly attached to the rail (20), the limited device (40) comprising:

an elevated body (42) with two ends having an inclined face (422) formed on one end;

two sets of limits protrusions (44,46) defined on each side of the elevated body (42);

an inclined edge (462) formed on the other ends of the elevated body (42) and smoothly linked up the limited protrusions (46);

an attachment plate (48) integrally extending from the inclined edge (462) and containing a through hole (49) whereby a positioning device such as a pin (492) can fixedly connect the attachment plate (48) of the limit device (40) to the rail (20); and a tab (47) extending from the base of the inclined face (422) of the limit device (40) and is fixedly inserted in the rail (20).

2. The detachable rail for a drawer track as claimed in claim 1, wherein the track (10) contains a slide wall (11) integrally extending from each side and each slide wall (11) has a guide (13) extending from the edge of the slide wall (11), wherein a limit plate (14) is located at one end of the sliding area (12) and a limit block (55) is located at the other end of the sliding area (12).

3. The detachable rail for a drawer track as claimed in claim 1, wherein the bearing (30) is U shaped and has a set of races (32) located on each leg of the "U" with each of the races (32) comprising multiple cavities (34) each containing a ball bearing (36), the size of the ball bearing (36) being so configured that the bearing (30) is slidable in the guide (13) of the track (10).

4. The detachable rail for a drawer track as claimed in claim 3, wherein the rail (20) is also U shaped and comprises a wing (22) located on each side and with each wing (22) being curved to form a sliding groove (24) having a size corresponding to the size of the ball bearing (36); and an opening (26) is further defined in the rail (20) with a lip (262) defined on one end of the opening (26), a hole (28) defined on the other side of the opening (26) to correspond to the through hole (49) of the limit device (40).

5. The detachable rail for a drawer track as claimed in claim 2, wherein the bearing (30) is U shaped and has a set of races (32) located on each leg of the "U" with each of the races (32) comprising multiple cavities (34) each containing a ball bearing (36), the side of the ball bearing (36) being so configured that the bearing (30) is slidable in the guide (13) of the track (10).

* * * * *